US008292126B2

(12) United States Patent
Pittaway et al.

(10) Patent No.: US 8,292,126 B2
(45) Date of Patent: Oct. 23, 2012

(54) BOTTLED LIQUID DISPENSERS

(75) Inventors: Clyde Pittaway, Bishop Auckland (GB); Philip Andrew Walton, Bishop Auckland (GB); Andrew Smith, Bishop Auckland (GB)

(73) Assignee: EBAC Limited, Bishop Auckland (GB)

( * ) Notice: Subject to any disclaimer, the term of this patent is extended or adjusted under 35 U.S.C. 154(b) by 1196 days.

(21) Appl. No.: 11/660,051

(22) PCT Filed: Aug. 11, 2005

(86) PCT No.: PCT/GB2005/003161

§ 371 (c)(1),
(2), (4) Date: Feb. 12, 2007

(87) PCT Pub. No.: WO2006/018614

PCT Pub. Date: Feb. 23, 2006

(65) Prior Publication Data

US 2007/0278250 A1 Dec. 6, 2007

(30) Foreign Application Priority Data

Aug. 14, 2004 (GB) ..... 0418185.5

(51) Int. Cl.
*B67D 5/06* (2006.01)

(52) U.S. Cl. ..... 222/185.1; 222/146.6; 222/457; 222/587; 62/397

(58) Field of Classification Search ..... 222/146.6, 222/457, 587, 185.1; 62/397, 398
See application file for complete search history.

(56) References Cited

U.S. PATENT DOCUMENTS

| | | | | | |
|---|---|---|---|---|---|
| 1,236,912 | A | * | 8/1917 | Cooper | 62/397 |
| 1,938,892 | A | * | 12/1933 | Buttner | 222/442 |
| 3,698,603 | A | * | 10/1972 | Radcliffe | 222/146.6 |
| 4,204,613 | A | * | 5/1980 | Terzian et al. | 222/146.6 |
| 4,324,349 | A | * | 4/1982 | Kaufman | 222/185.1 |
| 5,361,942 | A | * | 11/1994 | Salkeld et al. | 222/185.1 |
| 5,427,279 | A | * | 6/1995 | Kaufman | 222/207 |
| 5,544,788 | A | * | 8/1996 | Meyer | 222/110 |
| 5,979,709 | A | * | 11/1999 | Liccioni | 222/146.6 |

FOREIGN PATENT DOCUMENTS

EP 581491 A1 * 2/1994

* cited by examiner

*Primary Examiner* — Kevin P Shaver
*Assistant Examiner* — Donnell Long
(74) *Attorney, Agent, or Firm* — Ira S. Dorman

(57) ABSTRACT

A replaceable flow assembly for use in a water cooler or similar bottled liquid dispenser includes a liquid reservoir 7 and a manifold 48 incorporating a bottle connector 5, 49 for releasable sealing engagement with a neck formed on an inverted bottle. The manifold is mounted on the reservoir and incorporates a first pathway for conducting liquid from a feed tube 5 to the reservoir 7, and a second pathway for conducting liquid from the reservoir to a discharge outlet 53. A third pathway within the manifold conducts atmospheric air through an air filter 28 and into the interior of the bottle through the feed tube 5 without passing through the reservoir 7. The manifold preferably also incorporates a dispense valve between the reservoir 7 and the discharge outlet 53 (e.g. in arm 52), which co-operates with a fixed valve-operating member within the dispenser.

10 Claims, 6 Drawing Sheets

BOTTLED LIQUID DISPENSERS

TECHNICAL FIELD OF THE INVENTION

This invention relates to bottled liquid dispensers of the kind in which a liquid (usually water) is supplied from a bottle to a discharge outlet via a reservoir. Generally (but not always) the liquid is heated or cooled in the reservoir.

BACKGROUND

In recent years a great deal of attention has been paid to improving hygiene in bottled liquid dispensers with the object of preventing the multiplication of bacteria and other micro-organisms which could cause health problems.

In the older style of bottled water dispensers the reservoir and its associated components are essentially fixed in the dispenser. However, since the reservoir is open to the atmosphere it is possible for dirt and air-borne micro-organisms to enter the reservoir during use. It is therefore necessary to sanitize the components in situ during periodic routine maintenance.

An effective solution to this problem is proposed in EP 0 581 491 A (Ebac Limited) wherein the dispenser has a disposable reservoir, and a bottle connector incorporating a feed tube is releasably supported beneath the bottle for sealing engagement with a neck formed on the bottle. A first flexible tube conducts liquid from the bottle connector to the reservoir, and a second flexible tube conducts liquid from the reservoir to the discharge outlet via a dispense valve, thereby forming a continuous sealed liquid flow path from the bottle to the discharge outlet. External atmospheric air is prevented from entering the reservoir, but a duct provides a separate flow path by which atmospheric air may directly enter the bottle via the bottle connector without passing through the reservoir. Additional tubes may also be provided, for example to carry ambient water from the feed tube unit to a separate discharge outlet, or to route water through a separate hot reservoir and respective outlet. The feed tube unit, reservoir and interconnecting tubes are collectively called a WATER-TRAIL* assembly, referred to below as a flow assembly, which is intended to be periodically removed and replaced with clean components.

When installing such a flow assembly several separate operations must be performed. The reservoir must be fed into its receptacle and the feed tube unit must be engaged with its holder in the correct position to receive the neck of a bottle. At the same time, the flexible tubes must be correctly routed within the cooler to avoid possible kinks, and the tubes leading to discharge outlets must also be fed through fixed dispense valves.

The present invention seeks to provide a new and inventive form of flow assembly and bottled liquid dispenser, which maintains a high level of hygiene whilst simplifying the process of replacing the flow assembly.

SUMMARY OF THE INVENTION

The present invention proposes a flow assembly for a bottled liquid dispenser, wherein the flow assembly includes a reservoir for liquid, a bottle connector for releasable sealing engagement with a neck formed on an inverted bottle, a first pathway for conducting liquid from the bottle connector to the reservoir, a second pathway for conducting liquid from the reservoir to a discharge outlet via a dispense valve, and a third pathway for conducting atmospheric air to the interior of the bottle through the bottle connector without passing through the reservoir, characterised in that the bottle connector is incorporated in a manifold which is mounted on the reservoir and which provides the first, second and third pathways.

Within the scope of the invention, the manifold will incorporate at least a major part of each of the first, second and third pathways, and normally all of the first and second pathways. The third pathway preferably includes an air filter which is mounted within the manifold. At least the portion of the third pathway from the air filter through the bottle connector will be incorporated within the manifold.

The invention includes a bottled liquid dispenser which includes a housing containing:

a flow assembly according to any preceding claim, a thermal receptacle for receiving the reservoir, and support means for supporting the manifold.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

The drawings show various forms of bottled liquid dispenser of the kind which are generally referred to as water coolers.

Figure 1:
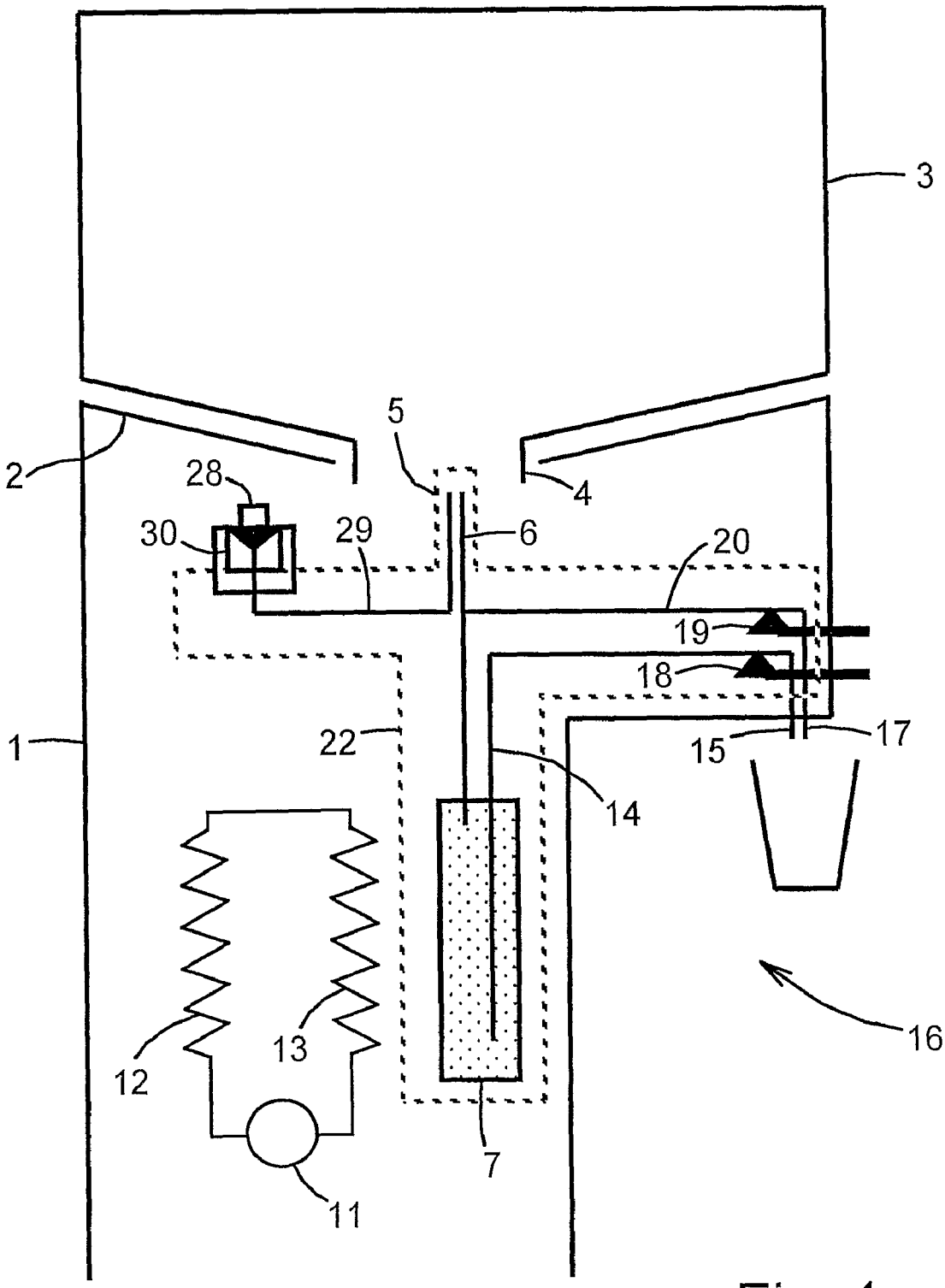
FIG. 1 is a schematic drawing showing the main components of a first form of water cooler in accordance with the invention, which employs a gravity feed system.

Referring to FIG. 1, the illustrated water cooler includes a housing 1 which is provided with a dish-like lid 2 forming a seat for a water bottle 3 which is mounted in an inverted position with its neck 4 inserted through an aperture in the lid 2. Prior to use, the neck of the bottle is provided with a closure cap (not shown). When the bottle is mounted on the seat 2, the cap becomes sealingly engaged with a bottle connector incorporating a feed tube 5. A transfer pathway 6 conducts liquid from the bottle through the feed tube 5 to a reservoir 7 within the housing 1. Water contained within the reservoir 7 may be cooled by a refrigeration system which includes a compressor 11, an air-cooled condenser 12 and an evaporator 13 which is mounted in close thermal contact with the reservoir 7. Chilled water is removed from the reservoir 7 via an outlet pathway 14 which terminates in a discharge outlet 15 disposed above a dispensing recess 16 formed in the housing 1. Flow control is achieved by means of a valve 18 which may be arranged for direct manual operation or indirect manual operation via an electrical switch and a solenoid. An ambient water pathway 20 may connect the transfer pathway 6 to a second discharge outlet 17 above the dispensing recess 16 via a second dispense valve 19 to provide a supply of water at room temperature. The water pathways from the bottle 3, through the feed tube 5, transfer pathway 6, reservoir 7 and outlet pathway 14 is fully sealed to prevent contact with atmospheric air, as is the pathway from the feed tube 5 to the second discharge outlet 17. On initial use, gravity causes water to flow through the water pathways from the bottle 3 to the discharge outlets 15 and 17, and air is purged through the discharge outlets so that the water pathways become substantially filled with water. Water displaced from the bottle is replaced by air which enters the bottle through a microfilter 28 and an air pathway 29 which leads into the bottle through the feed tube 5 separately from the water pathway 6. A non-return valve 30 may be included in the air pathway to prevent leakage of water, e.g. due to expansion of air within the bottle.

It will be appreciated that in each form of water cooler described herein water could also be supplied from the water transfer pathway 6 to a hot tank to be heated and dispensed through a separate discharge outlet above ambient temperature, for use in hot beverages for example.

In the first form of water cooler described above, water is transferred from the bottle to the discharge outlets by gravity. However, by employing pump-operated pressure-feed systems, two examples of which will now be described, the discharge outlets may be located in an elevated position.

Figure 2:
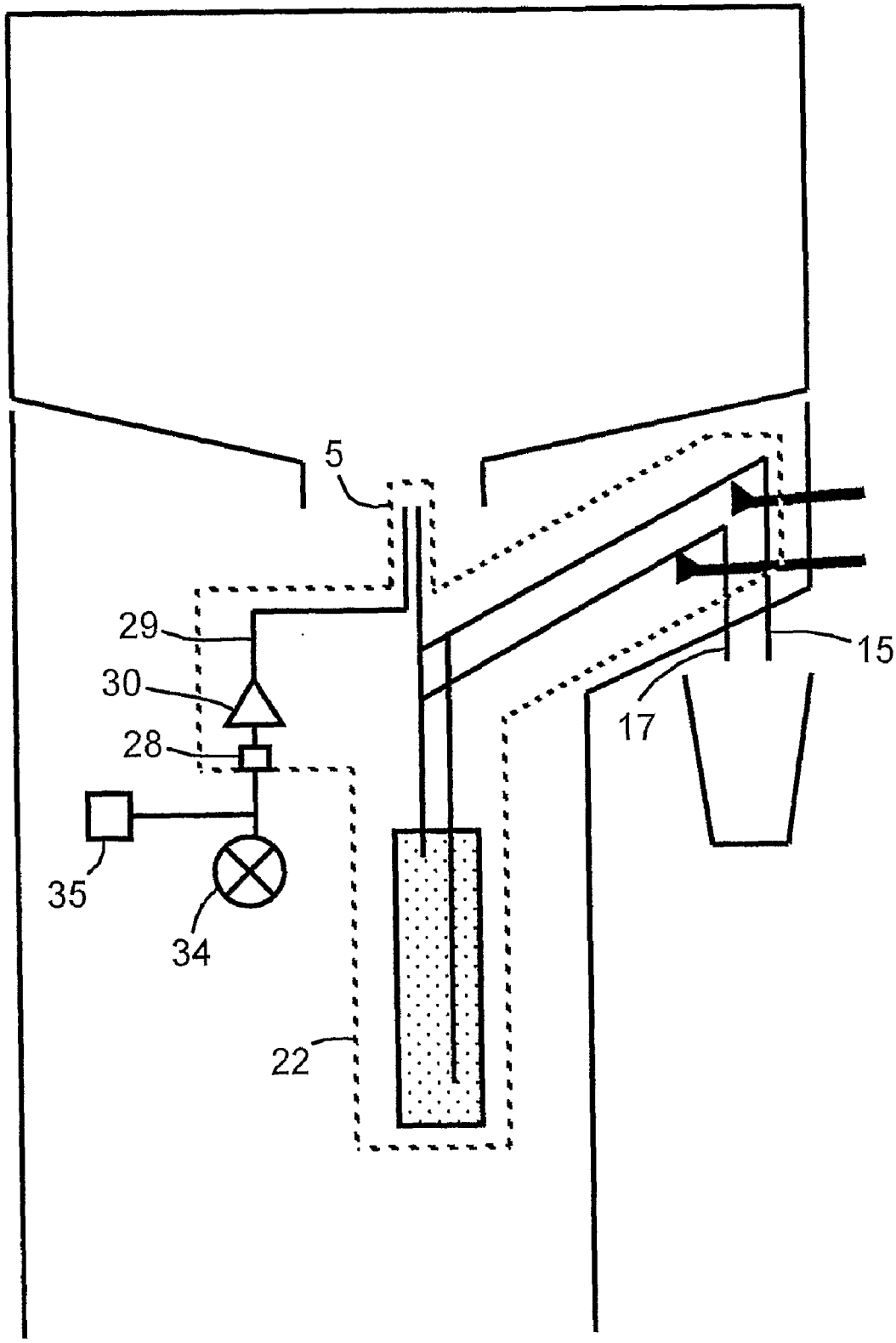
FIG. 2 is a schematic drawing showing the main components of a second form of the water cooler which employs a pressure-feed system.

Referring to FIG. 2 an air pump 34 supplies pressurised air to the bottle via the microfilter 28, air pathway 29 and non-return valve 30 to create a pressure head within the bottle. A pressure switch 35 may be provided to sense the pressure in the air pathway 29, switching off the pump 34 when a suitable operating pressure has been attained and switching the pump on again when the pressure falls. It is thus possible to position the discharge outlets 15 and 17 at a higher level relative to the feed tube 5 than is possible in a gravity feed system. In other respects the water cooler is the same as the cooler of FIG. 1. The refrigeration system has been omitted from the drawing.

Figure 3:
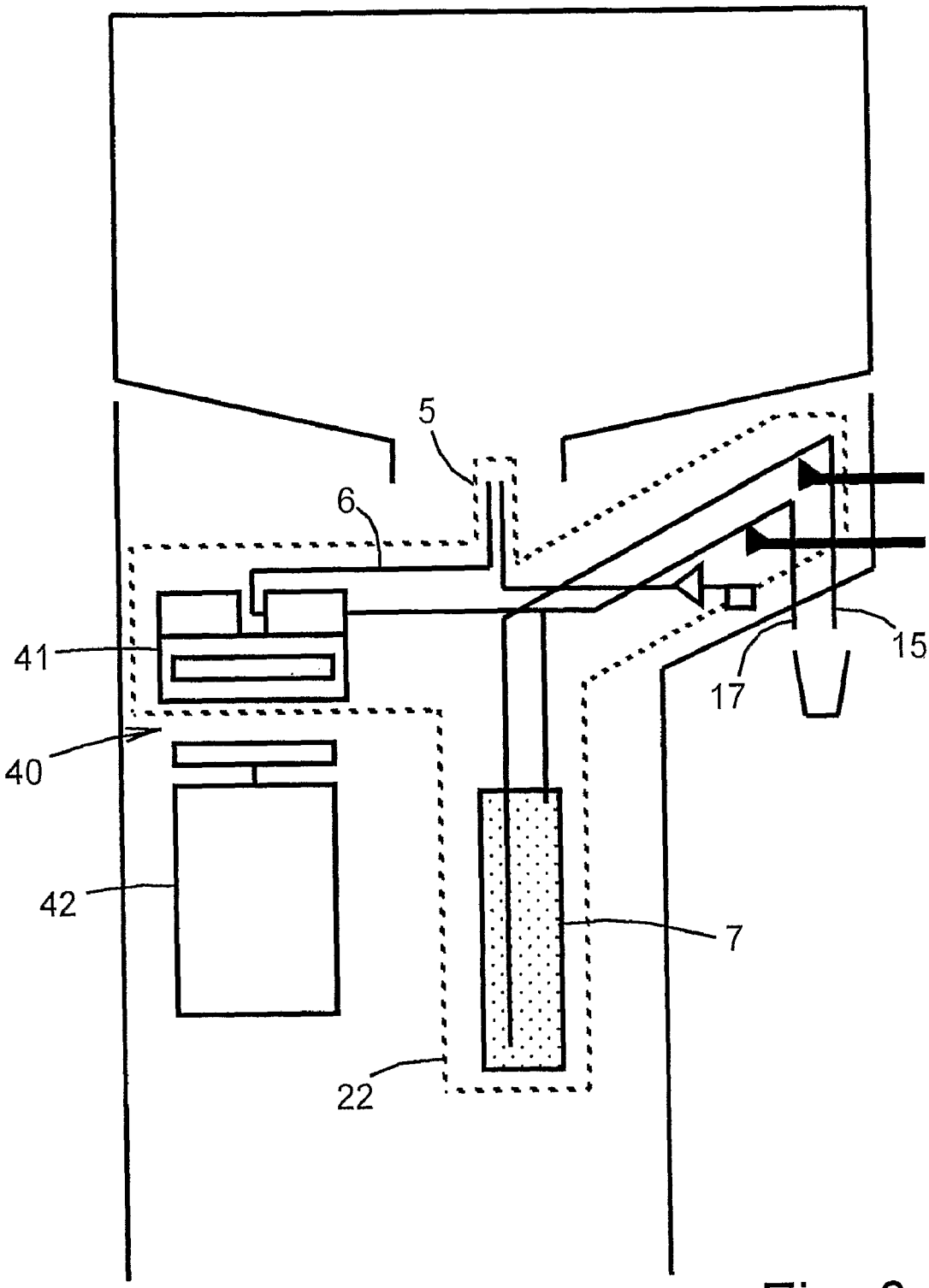
FIG. 3 is a schematic drawing showing the main components of a third form of the water cooler which employs a pumped feed system.

In the water cooler of FIG. 3 a water pump 40 is connected in the transfer pathway 6 to pump water from the bottle into the reservoir 7 and the second outlet 17 (if provided), thus creating an increased pressure head for dispensing water. The pump 40 is formed in two parts, namely a disposable pumping section 41 and a fixed motor assembly 42. The two parts may be drivably connected, e.g. by means of a mechanical drive or by magnetic coupling. In other respects the water cooler is the same as the cooler of FIG. 1. Again, the refrigeration system has been omitted in the drawing.

In the forms of water cooler described above, the feed tube 5, reservoir 7, the water pathways 6 and 14 and the air pathway 29 are provided by a replaceable flow assembly 22, one example of which will now be described for use in the water cooler of FIG. 3.

Figure 4:
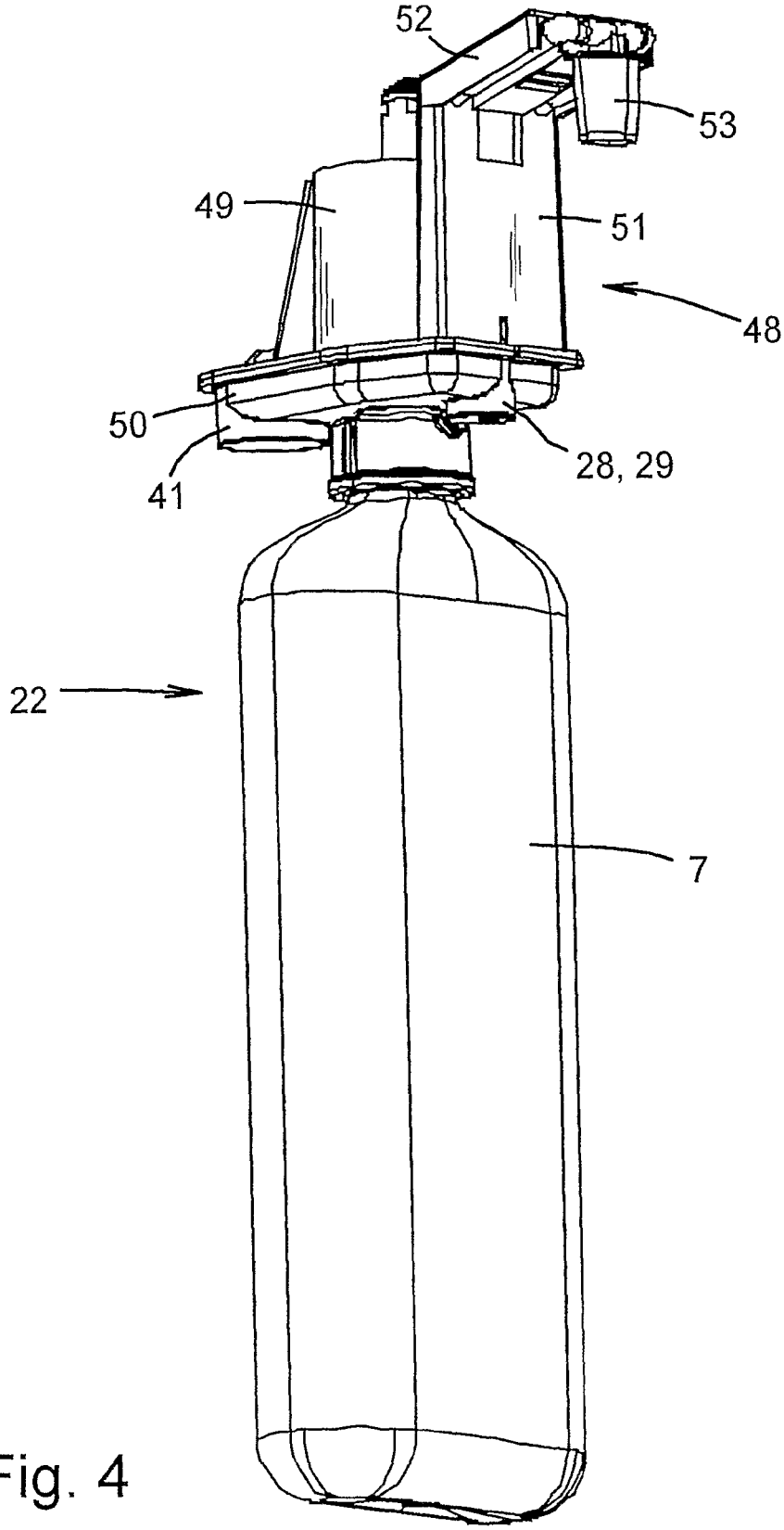
FIG. 4 is a general view of a flow assembly for use in the third form of the water cooler.

Referring to FIG. 4, the flow assembly 22 includes a semi-rigid manifold 48 which is mounted on a thin-walled reservoir 7 formed of blown HDPE or another non-porous flexible or semi-rigid thermoplastic. The manifold may be moulded of a rigid or semi-rigid thermoplastic such as ABS, and incorporates a receiver cup 49 into which the neck of the bottle is inserted in use, and which is upstanding from a generally planar and slightly elongate support platform 50. The feed tube 5 projects upwardly within the cup 49 for insertion into the bottle. A flat post 51 projects upwardly from the platform 50, joined to the cup 49, which in turn supports a flat arm 52, projecting outwardly with a slight upward inclination away from the cup 49. The free end of the arm 52 has a downwardly-projecting discharge spout 53 incorporating the discharge outlets 15 and 17 referred to above. The air filter 28 and non-return valve 29 are also incorporated into the platform, located below the post 51. At the opposite end, the platform incorporates the impeller assembly 41 of the water pump 40 described above.

Figure 5:
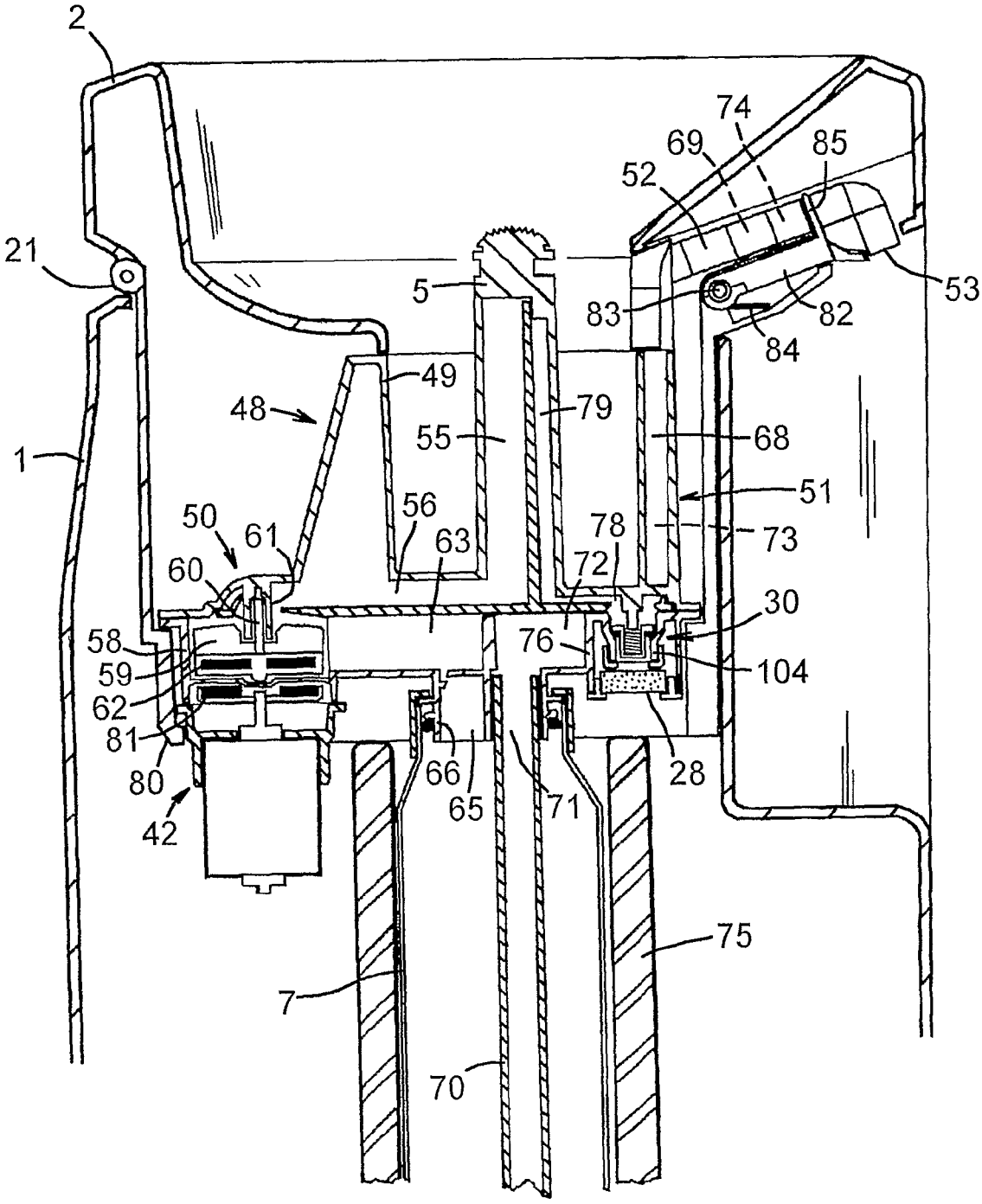
FIG. 5 is a vertical section through the flow assembly, including part of the water cooler.

The sectional view of FIG. 5 shows the internal structure of the manifold 48 together with various permanent components of the water cooler. The feed tube 5, which is positioned centrally of the receiver cup 49, contains an axial water passage 55 which is arranged to receive water from the bottle through the upper end of the feed tube. At the base of the feed tube, the axial passage 55 joins a horizontal water passage 56 within the platform 50 leading to the upper end of the impeller assembly 41. The platform 50 includes a cylindrical impeller housing 58 containing an impeller 59 with a vertical shaft 60, which is rotatably received in a bearing sleeve 61. The impeller is mounted on a magnetic element 62 located in the bottom of the housing 58. An outlet passage 63 leads tangentially from the side of the impeller housing 58 and travels through the platform below the passage 56. A reservoir coupling spigot 66 projects downwardly from the platform 50 beneath the cup 49 for sealing engagement with a neck of the reservoir 7. The outlet passage 63 communicates with a first passage 65 through the coupling spigot 66 to conduct water into the reservoir 7. In addition, the outlet passage 63 communicates with an ambient water passage 68 within the post 51 which in turn joins an ambient water passage 69 which travels along the arm 52 to the discharge spout 53.

Chilled water is removed from the lower region of the reservoir 7 through a dip tube 70 which is coupled to a second passage 71 within the coupling spigot 66. Chilled water is then conducted through a horizontal passage 72 within the platform 50 to a chilled water passage 73 in the post 51 to join a chilled water passage 74 which travels along the arm 52 to the discharge spout 53. Water displaced from the bottle is replaced by atmospheric air which can pass into the bottle through a separate pathway which commences at an air inlet housing 76, formed within the platform 50, containing the microfilter 28 and non-return valve 30. After passing through the non-return valve, air is conducted through a horizontal air passage 78 in the bottom of the cup to a second axial passage 79 within the feed tube 5 to enter the bottle through the upper end of the feed tube.

Although not shown, the platform 50 may contain an additional drain passage to remove water spillages from the cup 49.

The lid 2 may lift off the housing 1 or it can be hinged to the housing as at 21. The lid 2 is preferably held by manually releasable catches. The flow assembly is inserted through the top of the housing after raising the lid 2. The reservoir 7 drops into a thermal receptacle 75 until the manifold 48 rests on and is located by a support moulding 80 which is fixed within the housing 1. When the lid 2 is replaced the lid abuts the rim of the receiver cup 49 to hold the flow assembly in position. An electric motor assembly 42 of the water pump is permanently fixed to the support moulding 80 within the housing 1. The motor 42 is arranged to rotatably drive a second magnetic element 82 which is positioned to magnetically couple with the magnetic element 62 of the manifold 48. The motor assembly 42 thus drives the impeller 59 to move water from the bottle 3 into the reservoir 7 and create a sufficient head to ensure that water will issue from the spout 53 even when the water level within the bottle becomes low. The arm 52 rests on a pair of pinch elements 82 (only one of which is shown) which, in this example, are pivotably connected at 83 to the support moulding 80 and urged upwardly by respective springs 84 into the position shown. The pinch elements may be moved downwards against the action of the springs 84, either by respective manually-operated lever mechanisms or by solenoids energised remotely from manually operated switches (not shown). The pinch elements include respective pinch bars 85 which project upwardly in registration with the two water passages. When the lid 2 is replaced, the upper surface of the arm 52 is supported against the lid. As will be described more fully below, the pinch elements 82 function as operating members for the dispense valves, which control passage of water through the discharge spout 53.

Figure 6:
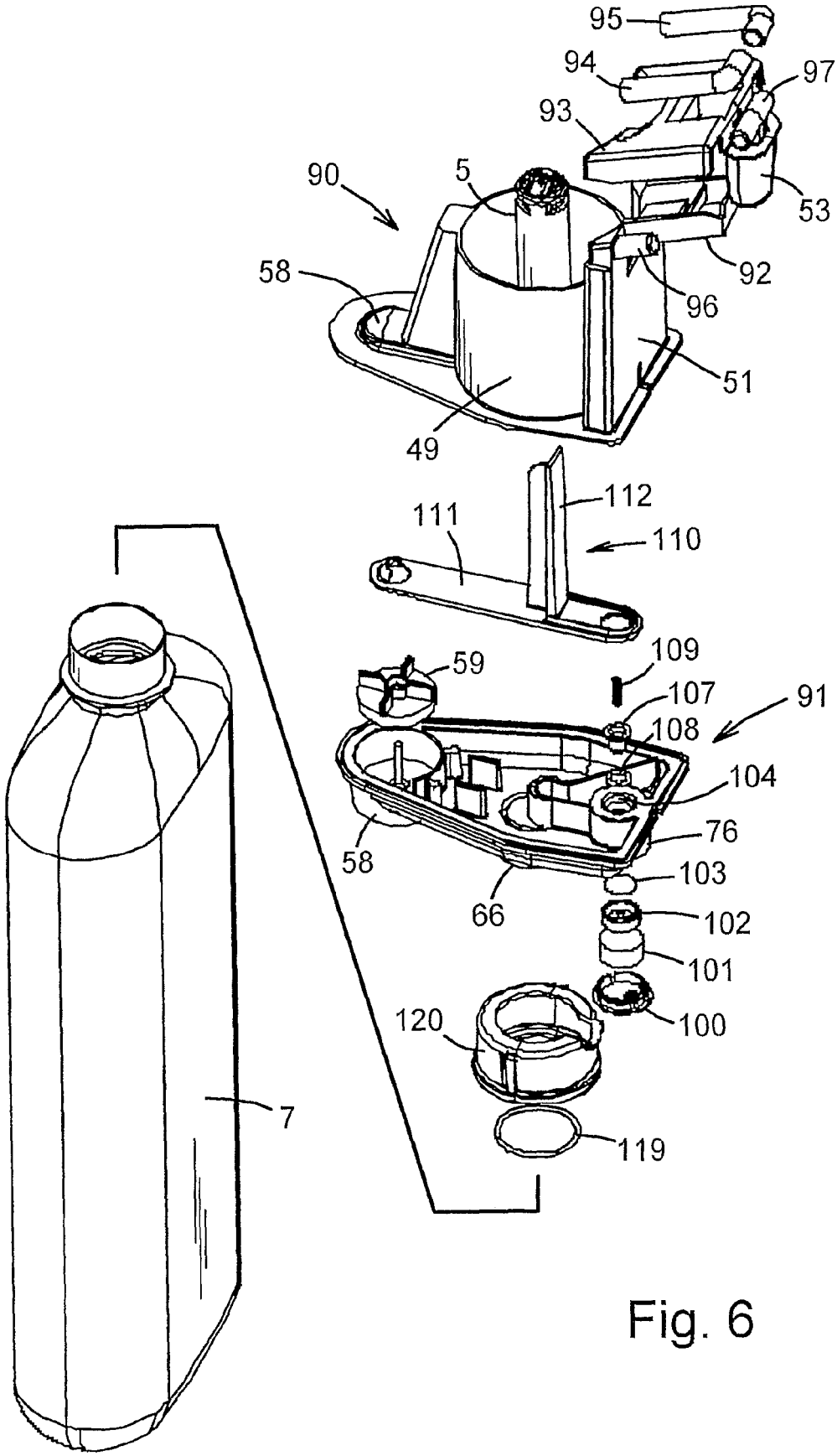
FIG. 6 is an exploded general view of the flow assembly.

Referring now to the exploded view of FIG. 6, the manifold is formed by an upper shell 90 and a lower shell 91, which are joined around the periphery of the platform 50, e.g. by welding or an adhesive. The upper shell 90 provides the feed tube 5, the receiver cup 49, a top part of the impeller housing 58 which incorporates the bearing sleeve 61 described above, the post 51 containing the the ambient water passage 68 and chilled water passage 73, and a lower section 92 of the arm 52. A separate moulding 93 provides an upper section of the arm 52 and discharge spout 53, and short sections of silicone tubing 94 and 95 provide the water passages 69 and 74 respectively. These sections of tubing are received within the upper arm moulding 93, coupled between respective spigots 96 and 97 on the post 51 and discharge spout 53 respectively, and the underside of the moulding 93 is open to permit the pinch bars 85 to nip the tubes against the moulding 93 under the action of the springs 84, thereby independently controlling flow of water through the respective tubes 94 and 95.

The lower shell 91 of the manifold provides the bottom part of the impeller housing 58, which contains the impeller 59, reservoir coupling spigot 66 and the air inlet housing 76. The lower end of the housing 76 is closed by an apertured cap 100 to retain a coarse air filter 101, a separator ring 102 and a microfilter 103. A short internal cylindrical wall 104 is moulded within the housing 76 (FIG. 5) to receive a valve element 107 which is urged downwardly against an O-ring seal 108 by a spring 109 to close the air path through the cylindrical wall 104 until the pressure within the bottle falls sufficiently to lift the valve element 107 and admit air into the bottle.

An air separator 110 is inserted between the upper and lower shells 90 and 91. A horizontal web 101 of the air separator divides the upper horizontal water passage 56 from the lower water outlet passage 63, and also separates the chilled water passage 72 from the air passage 78. A perpendicular web 102 projects upwardly into the feed tube 5 to divide the interior of the feed tube into the separate air and water passages 79 and 55 respectively.

An O-ring 119 is located about the coupling spigot 66 to seal the spigot to the reservoir 7, and a neck ring 120 is engaged about the spigot 66 to connect the reservoir to the lower shell 91.

Although one embodiment of the flow assembly has been described in detail it will be appreciated that various modifications are possible within the scope of the invention. For example, the impeller could be omitted as in FIGS. 1 and 2, with the post 51 being shorter or absent altogether in the case of a gravity feed system. The non-return valve in the air inlet to the bottle could take the form of a float valve as in FIG. 1, and the air inlet housing could sealably connect with a fixed air pump as in FIG. 2. Furthermore, the manifold could be arranged to simultaneously feed water to a replaceable hot tank with a respective hot water outlet incorporated in the manifold as mentioned above.

Other forms of dispense valves could be used instead of the pinch valves described. For example, the manifold could incorporate poppet valves arranged to co-operate with respective valve-operating members which are permanently fixed in the housing, either having direct manual activation or operated indirectly by means of solenoids.

It will be appreciated that the features disclosed herein may be present in any feasible combination. Whilst the above description lays emphasis on those areas which, in combination, are believed to be new, protection is claimed for any inventive combination of the features disclosed herein.

*WATERTRAIL is a registered trademark of Ebac Limited.

The invention claimed is:

1. A bottled liquid dispenser comprising, in combination:

a housing;

a flow assembly replaceably received in the housing and including a manifold having an underside, and a reservoir for liquid, said reservoir for liquid being separate from said manifold and engaged with the underside of said manifold, a bottle connector for releasable sealing engagement with a neck formed on an inverted bottle, said bottle connector being incorporated in the manifold and including a receiver cup and a feed tube, a first pathway for conducting liquid from the feed tube of the bottle connector to the reservoir, a second pathway for conducting liquid from the reservoir to a discharge outlet which is separate from the feed tube, a third pathway for conducting atmospheric air to the interior of the bottle through the feed tube without passing through the reservoir, said manifold providing said first, second, and third pathways such that said first, second, and third pathways are mutually separate;

a thermal receptacle mounted in the housing and receiving the reservoir of the flow assembly; and a support structure, fixed in said housing, supporting the underside of said manifold;

the arrangement being such that the flow assembly can be removed from the housing as a unitary item and replaced.

2. A bottled liquid dispenser according to claim 1 in which the manifold comprises an upper moulded shell and a lower moulded shell which are sealably joined together.

3. A bottled liquid dispenser according to claim 1 in which the third pathway includes an air filter which is mounted within the manifold.

4. A bottled liquid dispenser according to claim 1 in which the third pathway includes a non-return valve which is mounted within the manifold.

5. A bottled liquid dispenser according, to claim 1 in which the manifold provides a fourth pathway for conducting liquid from the first pathway to a further discharge outlet without passing through the reservoir.

6. A bottled liquid dispenser according to claim 1 in which the second pathway travels through a post which is upstanding from the manifold alongside the bottle connector.

7. A bottled liquid dispenser according to claim 6 in which an arm projects from the upper end of the post away from the bottle connector, and the second pathway travels through the arm.

8. A bottled liquid dispenser according to claim 7 in which the arm carries said discharge outlet through which liquid is dispensed after passing through said second pathway.

9. A bottled liquid dispenser according to claim 1 in which the housing has a removable apertured lid for supporting an inverted bottle with its neck projecting therethrough, said lid overlying the receiver cup of said bottle connector.

10. A bottled liquid dispenser according to claim 9 in which the lid holds the manifold between the lid and the support structure of the housing.

* * * * *